US006296244B1

(12) United States Patent
Hanks et al.

(10) Patent No.: US 6,296,244 B1
(45) Date of Patent: Oct. 2, 2001

(54) METHOD AND APPARATUS FOR GUIDING MEDIA

(75) Inventors: David W. Hanks; Donald B. MacLane, both of Portland, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/277,856

(22) Filed: Mar. 26, 1999

(51) Int. Cl.[7] ..... B65H 3/06
(52) U.S. Cl. ..... 271/118; 271/117; 271/10.12
(58) Field of Search ..... 271/118, 117, 271/109, 121, 10.11, 10.12

(56) References Cited

U.S. PATENT DOCUMENTS

| | | | | |
|---|---|---|---|---|
| 3,411,768 | * | 11/1968 | Gatti | 271/117 |
| 3,640,524 | * | 2/1972 | Fredrickson | 271/36 |
| 3,785,638 | * | 1/1974 | Beazley | 271/117 |
| 4,306,713 | * | 12/1981 | Avritt et al. | 271/37 |
| 4,310,151 | * | 1/1982 | Fujimoto | 271/11 |
| 5,377,969 | | 1/1995 | Steinhilber | 271/21 |
| 5,507,478 | * | 4/1996 | Nottingham et al. | 271/10.02 |
| 5,615,873 | * | 4/1997 | Kobayashi et al. | 271/121 |
| 5,620,269 | | 4/1997 | Gustafson | 400/624 |
| 6,158,733 | * | 12/2000 | Muraki | 271/127 |
| 6,168,146 | * | 1/2001 | Komuro et al. | 271/10.12 |
| 6,203,005 | * | 3/2001 | Bednarek et al. | 271/121 |
| 6,209,862 | * | 4/2001 | Kelley | 271/18 |

FOREIGN PATENT DOCUMENTS

| | | | | |
|---|---|---|---|---|
| 57-13036 | * | 1/1982 | (JP) | 271/117 |
| 65-51521 | * | 3/1987 | (JP) | 271/117 |
| 1-117138 | * | 10/1989 | (JP) | 271/118 |
| 1-288539 | * | 11/1989 | (JP) | 271/117 |
| 2-282125 | * | 11/1990 | (JP) | 271/117 |
| 5-338826 | * | 12/1993 | (JP) | 271/118 |

OTHER PUBLICATIONS

IBM Technical Disclosure Bulletin, vol. 19, No. 7 Dec. 1976, "Sheet Feeding Apparatus" —Fallon et al.*

* cited by examiner

*Primary Examiner*—Donald P. Walsh
*Assistant Examiner*—Daniel K Schlak
(74) *Attorney, Agent, or Firm*—Philip T. Virga

(57) ABSTRACT

A media guiding apparatus and related method for reliably directing a media sheet from a media tray to a transport nip are provided. In one embodiment the media guiding apparatus includes at least one guide member that extends from a first guide surface adjacent to the transport nip to the sheet separator in the media tray. The guide member cooperates with a second guide surface to create a substantially uninterrupted media path between the sheet separator and the transport nip. The guide member is also extendible as the sheet separator moves relative to the first and second guide surfaces within the media tray. In another embodiment, the media guiding apparatus comprises a fan that creates a positive air pressure that urges the sheet against a guide surface as the sheet advances toward the transport nip.

12 Claims, 7 Drawing Sheets

METHOD AND APPARATUS FOR GUIDING MEDIA

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

This invention relates generally to an apparatus and method for guiding media in a media supply apparatus and, more specifically, to a media guiding apparatus that reliably guides a sheet of media upwardly along a guide surface to a transport nip.

BACKGROUND OF THE INVENTION

Many imaging apparatus, such as ink jet and electrophotographic printers, copiers and the like, utilize one or more media trays to hold a stack of sheets of media. A mechanism in the tray or in the printer housing separates and delivers individual sheets to the imaging apparatus for printing or copying. One well-known type of media tray takes the form of a rectangular bin having vertical walls for containing the stack of media. This type of tray utilizes springs and pressure plates to urge the stack of media upwardly against one or more drive rollers that feed individual sheets to the imaging apparatus.

Another type of tray and sheet delivery mechanism that does not use springs or pressure plates is disclosed in U.S. Pat. No. 5,377,969 (the '969 patent). FIG. 2 of the present application schematically illustrates a portion of this type of mechanism and tray, generally indicated by the reference numeral 30. The tray includes a bottom support surface 26 on which a stack of paper 14 is placed flat. At a delivery end of the support surface 26 is an inclined wall 32 that is oriented up and away from the support surface 26 and the stack of paper 14. The sheet delivery mechanism utilizes a sheet separator 11 that includes a support arm 12 and a roller 16 rotatably coupled to the arm. The separating roller 16 rests on the stack of media 14 and acts by friction to push individual sheets laterally against and upwardly along a slanted guide surface or ramp 6 on the upwardly inclined wall 32.

The support arm 12 is pivotally mounted in the printer housing to allow the arm to rise and fall with the height of the media stack 14 (indicated by action arrow A). The support arm 12 may also move laterally away from the ramp 6 and over the stack of media 14 (indicated by action arrow B). This lateral movement allows for a sufficient distance between the ramp 6 and the roller 16 to insure that the top sheet 4 bends between its front edge against the ramp and its contact line with the roller. This bending is necessary for the front edge of the sheet 4 to be pushed along the ramp 6 and lifted up from the stack 14. When the tray 30 is removed from the printer, the support arm 12 pivots upwardly and is stored behind the transport rollers 15, 17.

In proper operation, the separating roller 16 urges a sheet 4 upwardly along the ramp 6 and into a guide surface 10 that directs the sheet into the transport nip 8 for delivery to the printer. As illustrated in FIG. 2, however, in certain situations the sheet 4 can float or curl away from the ramp 6 and thereby miss the guide surface 10 and transport nip 8. This misfeed requires the user to remove the tray and clear the misfed sheet.

What is needed is a media guiding apparatus that reliably delivers a media sheet to the transport nip 8, while also allowing the support arm 12 to move freely within the tray during operation and to pivot upwardly for storage when the tray is removed.

SUMMARY OF THE INVENTION

It is an aspect of the present invention to provide a media guiding apparatus in a media supply apparatus.

It is another aspect of the present invention to provide a guided media path between a sheet separator in the media tray and a transport nip.

It is a feature of the present invention to provide a substantially uninterrupted media path between the sheet separator and the transport nip regardless of the height of the media stack or the position of the sheet separator in the media tray.

It is another feature of the present invention that the media guiding apparatus allows the sheet separator to freely move within the media tray.

It is yet another feature of the present invention that a media guide is extendible as the sheet separator moves within the media tray.

It Is an advantage of the present invention that the media guiding apparatus avoids sheet misfeeds caused by sheets curling away from the transport nip.

It is another advantage of the present invention that the media guide is a simple and reliable mechanism.

To achieve the foregoing and other aspects, features and advantages, and in accordance with the purposes of the present invention as described herein, a media guiding apparatus and related method for reliably directing a media sheet from a media tray to a transport nip are provided. In one embodiment, the media guiding apparatus includes at least one guide member that extends from a first guide surface adjacent to the transport nip to the sheet separator in the media tray. The guide member cooperates with a second guide surface spaced from the first guide surface to create a substantially uninterrupted media path between the sheet separator and the transport nip. The guide member is also extendible as the sheet separator moves relative to the first and second guide surfaces within the media tray. In another embodiment, the media guiding apparatus comprises a fan that creates a positive air pressure that urges the sheet against the guide surface as the sheet advances toward the transport nip.

Still other aspects of the present invention will become apparent to those skilled In this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
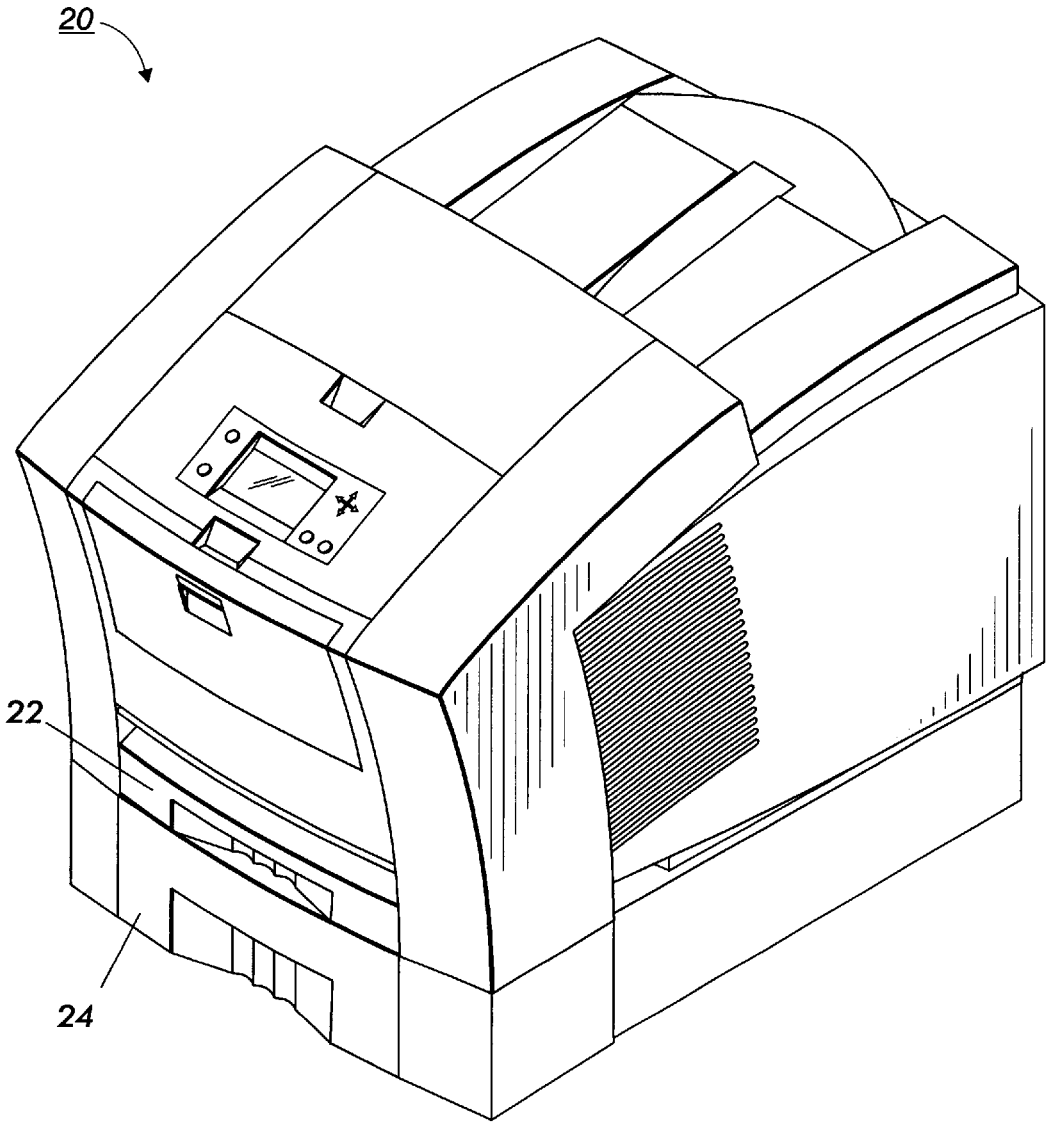
FIG. 1 is an overall perspective view of an ink let printer that uses the apparatus and method of the present invention.

FIG. 1 is an overall perspective view of an ink jet printer, generally indicated by the reference numeral 20, that utilizes the media guiding apparatus and related method of the present invention. To facilitate discussion, the term paper will be used instead of the term media to refer to all forms of media, including paper, transparencies, etc. Additionally, the present invention is not limited to use with an ink jet printer, but may be embodied in and practiced with any imaging apparatus that utilizes a paper tray or media supply apparatus, such as electrophotographic printers and copiers, thermal wax transfer printers, dye sublimation printers, etc. Accordingly, the following description is merely illustrative of one imaging apparatus with which the present invention may be utilized.

With reference to FIG. 1, the standard configuration of the ink jet printer 20 includes a standard capacity paper tray 22. A higher capacity auxiliary paper tray 24 may be added to the printer 20 to reduce the frequency of paper reloading. One embodiment of the auxiliary paper tray 24 utilizes a sheet delivery mechanism similar to the one discussed above and illustrated in FIG. 2. A more detailed description of this type of paper feeding mechanism is disclosed in U.S. Pat. No. 5,377,969 (the '969 patent), which is specifically incorporated by reference in its entirety.

Figure 2:
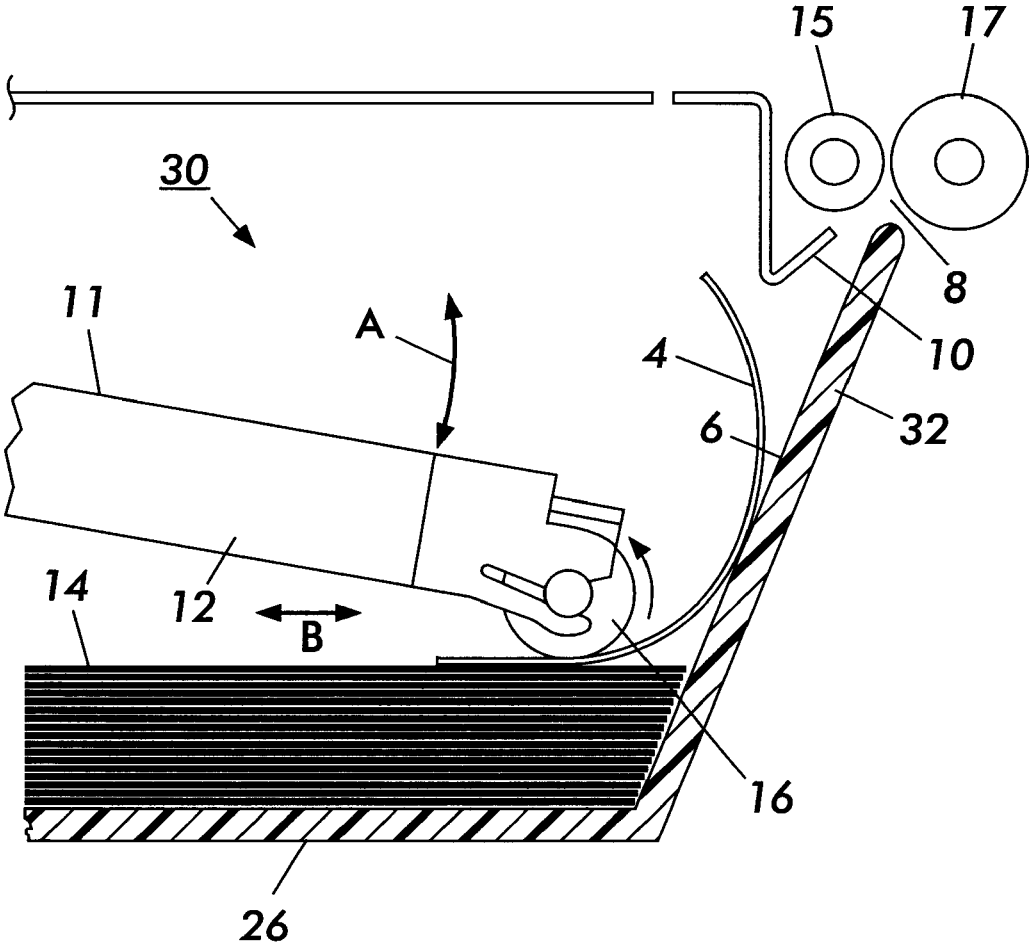
FIG. 2 PRIOR ART
FIG. 2 is a partial cross sectional view of a prior art media tray and sheet delivery mechanism.
Figure 3:
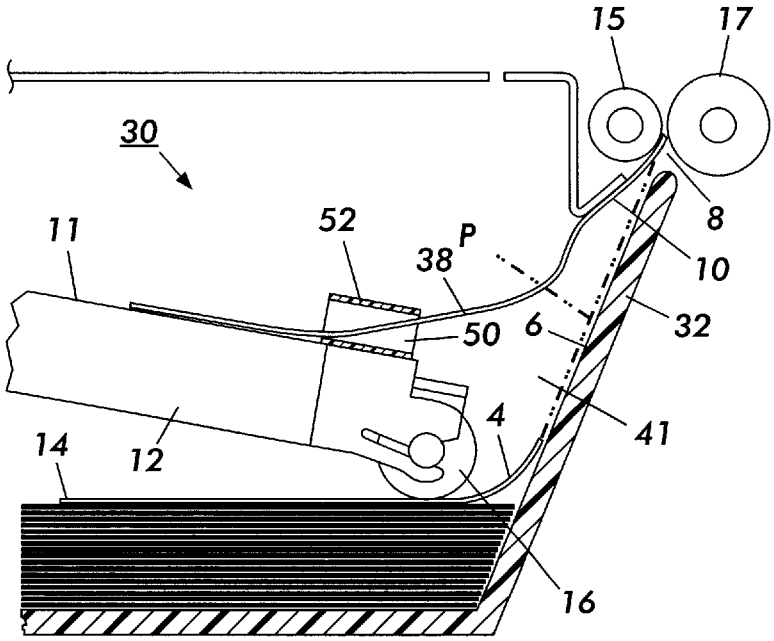
FIGS. 3 and 4 show the media tray and sheet delivery mechanism of FIG. 2 incorporating a media guiding apparatus according to the present invention.
Figure 4:
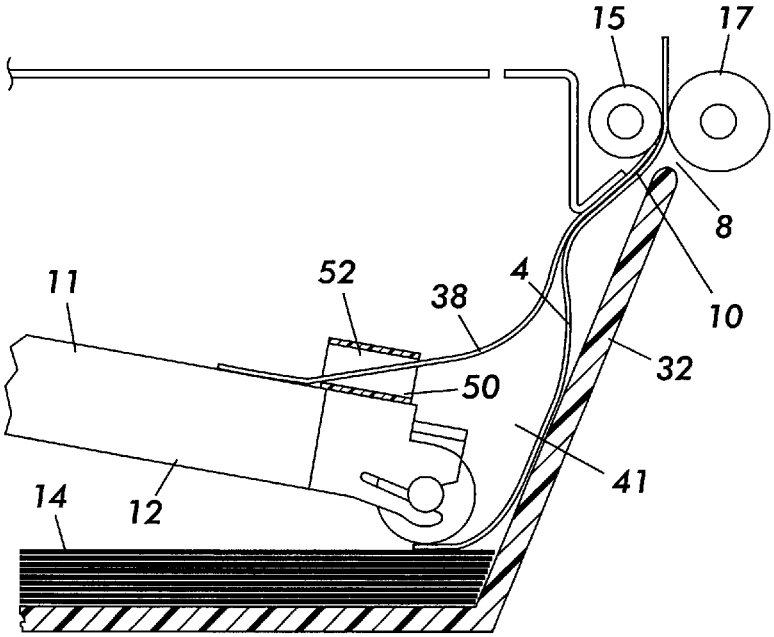

With reference now to FIGS. 3 and 4, the present invention will be described in relation to the sheet delivery mechanism of FIG. 2. To ensure that the paper 4 reliably feeds into the transport nip 8 and to avoid paper jams caused by misfeeding, one embodiment of the present invention provides a guide member 38 that creates a substantially uninterrupted media path between the sheet separator 11 and the transport nip 8. In its broadest aspects, this embodiment maintains the sheet 4 within a guided area 41 that is generally bounded by the guide member 38 and first guide surface 10, the structure of the sheet separator 11 between the guide member 38 and the stack of paper 14, and the ramp 6. As shown in FIGS. 3 and 4, the guide member 38 extends from the first guide surface 10 to the sheet separator 11. The guide member 38 cooperates with the ramp 6 on the upwardly inclined wall 32 to create a substantially uninterrupted paper path, generally indicated by the reference letter P, between the sheet separator and the transport nip 8. It will be appreciated that the paper path P may be any route within the guided area 41 that directs the sheet 4 upwardly between the guide member 38 and the ramp 6 and into the transport nip 8.

Advantageously, In the situation where a sheet floats away from the ramp 6 as it is advanced toward the nip, the sheet contacts the guide member 38 and is directed to the first guide surface 10 and into the nip 8 (see FIG. 4). The guide member 38 may have any desirable width that functions to reliably guide a sheet to the transport nip 8. For example, the guide member 38 may be substantially as wide as the widest sheets contained in the tray 30.

In an important aspect of the present invention, the guide member 38 maintains the substantially uninterrupted paper path P regardless of the position of the support arm 12. In one embodiment, the sheet separator 11 includes an opening 50 through which the guide member 38 extends. The opening 50 may be contained in a housing 52 that is mounted on the arm 12 of the sheet separator 11. A comparison of FIGS. 3 and 4 shows the movement of the sheet separator 11 downwardly as the height of the stack of paper 14 is reduced. As the support arm 12 moves down, the guide member 38 slides through the housing 52 to maintain the paper path P. In this manner, the guide member 38 is extendible as the sheet separator 11 moves generally toward and away from the first guide surface 10 and transport nip 8. Preferably, the guide member 38 takes the form of a flexible strip or sheet that easily conforms to the varying positions of the support arm 12. It will be appreciated that many other types and configurations of guide members may be utilized to create the substantially uninterrupted paper path of the present invention. Examples of other guide members include telescoping tubing, chain material, woven metal and fiber guide members.

Figure 5:
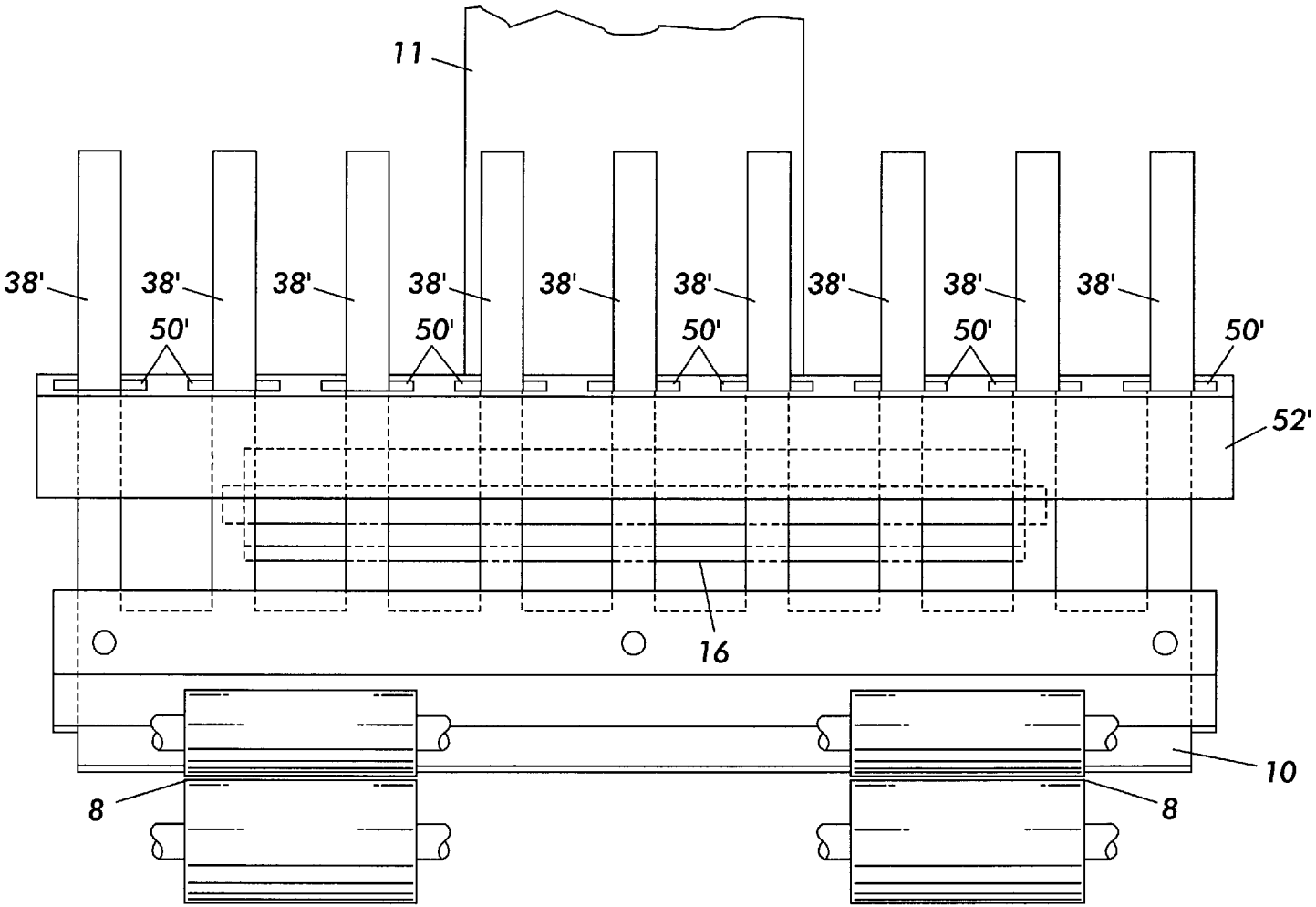
FIG. 5 is a top view of a second embodiment of a media guiding apparatus.
Figure 6:
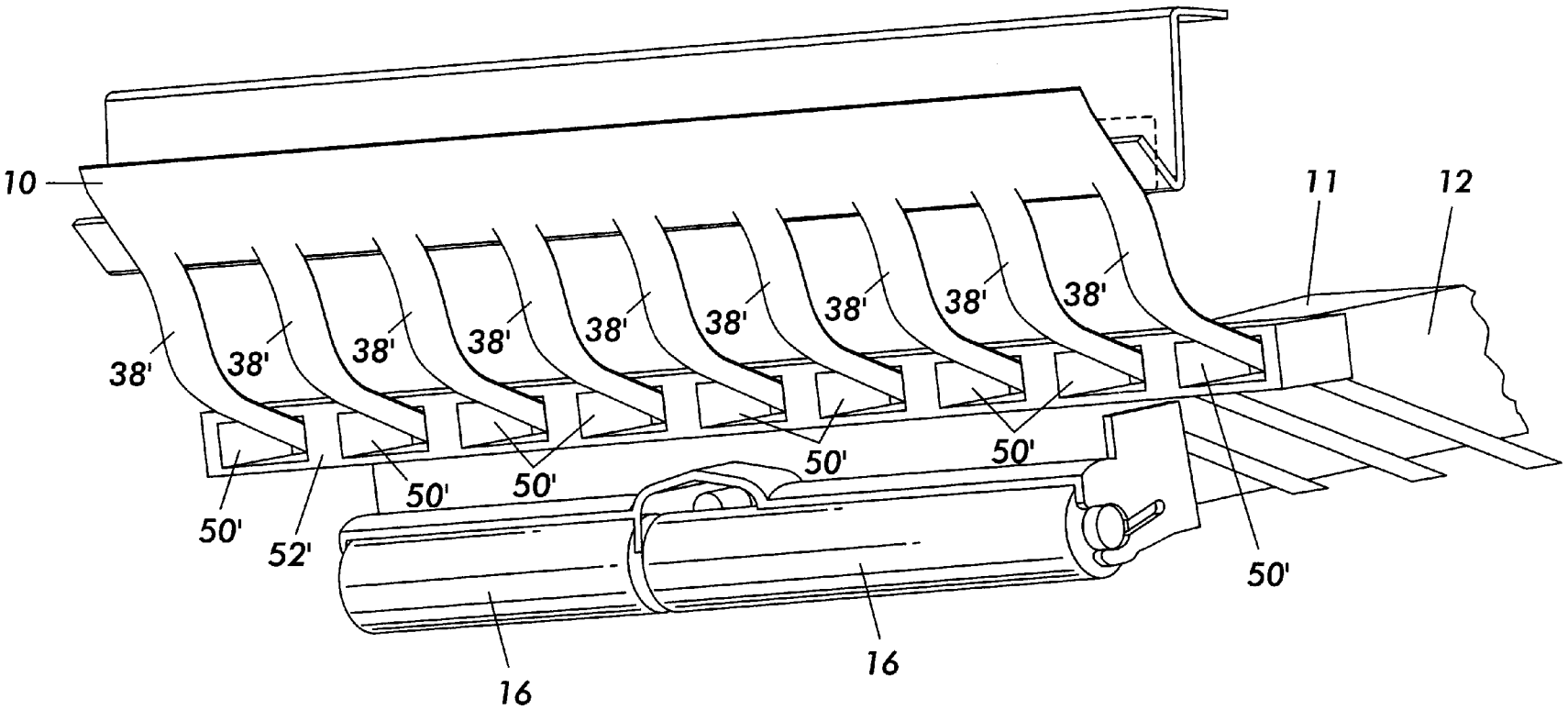
FIG. 6 is a perspective view of the second embodiment of the media guiding apparatus.
Figure 7:
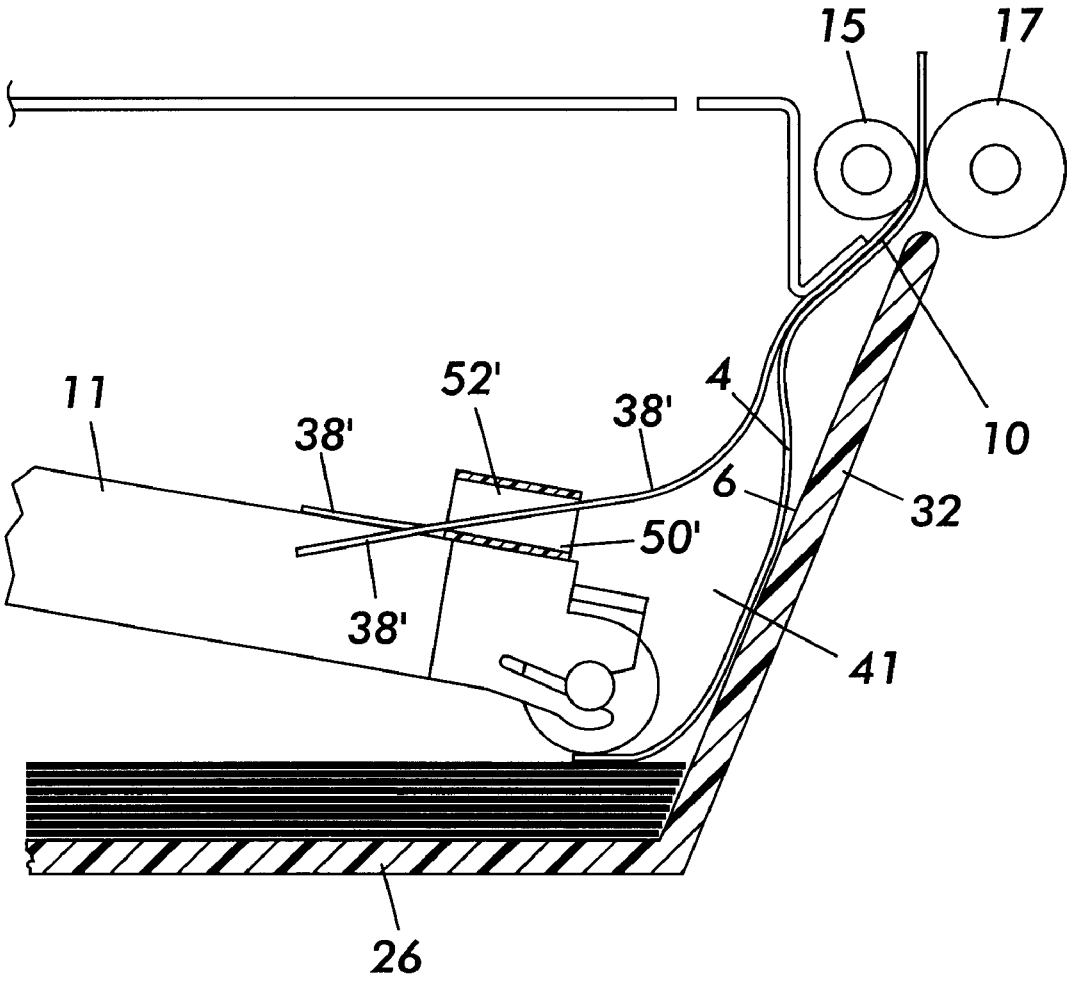
FIG. 7 is a partial cross sectional view of the second embodiment of the media guiding apparatus, the media tray and the sheet delivery mechanism.

With reference now to FIGS. 5–7, a second embodiment of the present invention utilizes a plurality of guide members 38' that extend from the first guide surface 10 to the sheet separator 11. The sheet separator 11 includes an elongated housing 52' that contains a plurality of openings 50' through which each of the guide members 38' extends. In this embodiment, the plurality of guide members 38' are spaced apart to span substantially the full width of the sheets being transported. Advantageously, the guide members provide substantially full width guidance to direct the sheets of paper into the transport nip 8.

Figure 8:
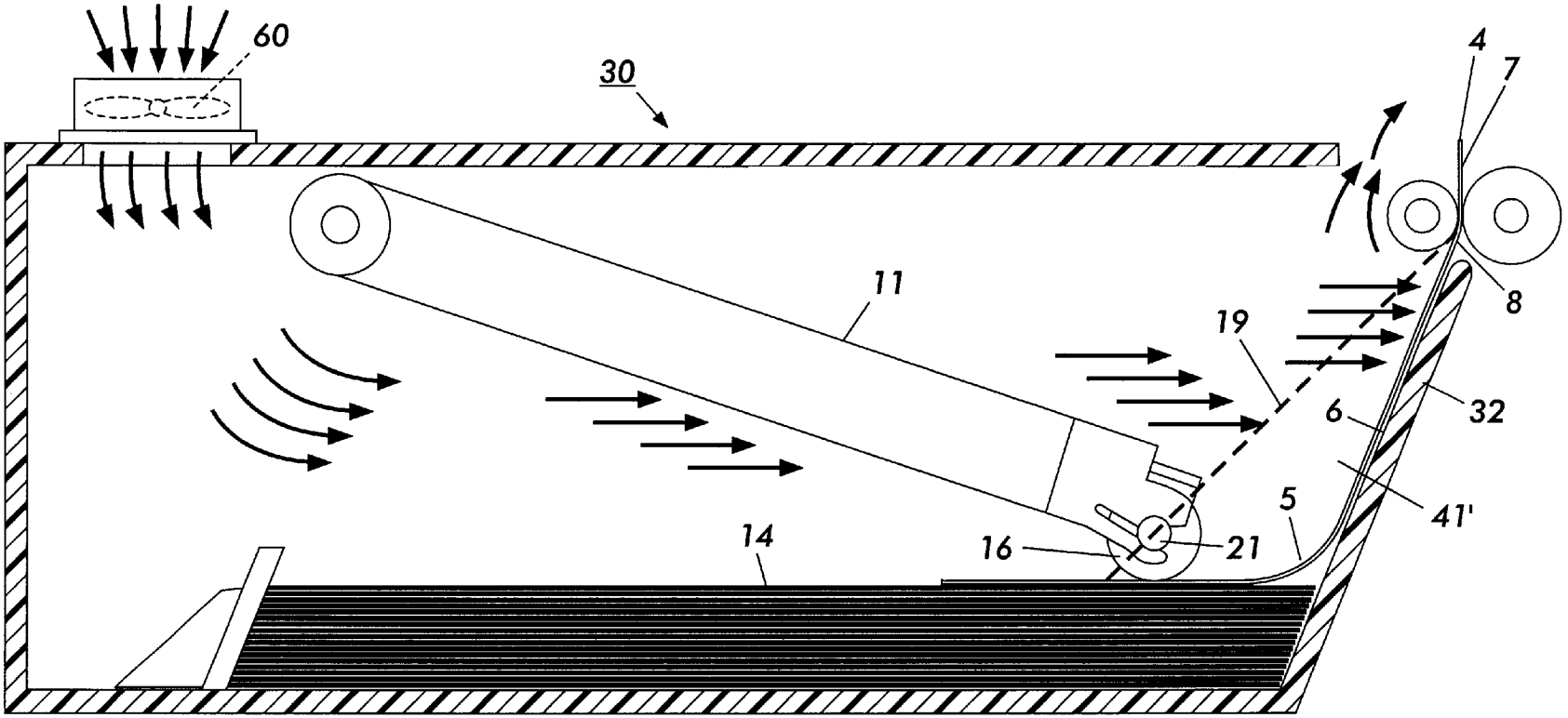
FIG. 8 is a schematic view of a media guiding apparatus that creates a positive air pressure within the media tray to urge the sheet against the guide surface.

FIG. 8 is a schematic view of a third embodiment of the present invention that manipulates air pressure to guide a sheet 4 into the transport nip 8. Like the other embodiments of the present invention described above, this embodiment maintains the sheet 4 within a guided area 41', which in this case is generally bounded by the ramp 6, the top of the stack of paper 14 and a line 19 extending from the transport nip 8 through an axis of rotation 21 of the roller 16. In the embodiment shown in FIG. 8, the means for maintaining the sheet 4 within the guided area 41' comprises a fan 60 that creates an airflow against a top side 5 of the sheet 4 as the sheet advances to the transport nip 8. This airflow creates a positive air pressure on the top side 5 of the sheet 4 that urges the sheet against the ramp 6. The fan 60 may be mounted in the tray 30 or alternatively in the printer to generate an airflow pathway into the tray. Like the other embodiments described above, the embodiment shown in FIG. 8 allows the sheet separator 11 to freely move within the tray 30.

Alternatively, the maintaining means may comprise one or more apertures (not shown) in the ramp 6. The aperture(s) alleviate any pressure accumulation between the bottom side 7 of the sheet 4 and the ramp 6. Advantageously, incorporating the aperture(s) into the ramp 6 may obviate the need for the creation of a positive air pressure on the top side 5 of the sheet 4. In this situation, a fan 60 or other means for urging the sheet against the ramp 6 is not necessary.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different imaging apparatus, all without departing from the inventive concepts disclosed herein.

The above embodiments were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled.

What is claimed is:

1. A media guiding apparatus in a media supply apparatus, the media supply apparatus containing a plurality of sheets of media and including a transport nip and a sheet separator for moving a top sheet of the plurality of sheets of media, the media guiding apparatus comprising:

a first guide surface adjacent to the transport nip;

a second guide surface spaced from the first guide surface;

a plurality of guide members extending from the first guide surface to the sheet separator to direct a sheet of media to travel between the second guide surface and the guide member toward the transport nip, wherein the sheet separator includes an elongated housing containing a plurality of openings, and each of the plurality of guide members extends through one of the plurality of openings.

2. The media guiding apparatus of claim 1, wherein the sheet separator is moveable generally toward and generally away from the transport nip, and wherein the sheet separator includes an opening through which at least one guide member extends.

3. The media guiding apparatus of claim 2, wherein the sheet separator comprises at least one roller rotatably attached to an arm and a housing mounted on the arm, and wherein the opening is contained in the housing.

4. The media guiding apparatus of claim 1, wherein at least one guide member is a flexible strip.

5. The media guiding apparatus of claim 1, wherein at least one guide member is extendible as the sheet separator moves toward and away from the first guide surface.

6. The media guiding apparatus of claim 5, wherein the plurality of guide members span a substantially full width of the sheet of media.

7. The media guiding apparatus of claim 5, wherein the plurality of guide members are spaced apart.

8. A media guiding apparatus in a media supply apparatus, the media supply apparatus including a transport nip and a sheet separator for moving a top sheet of the plurality of sheets of media, the media guiding apparatus comprising:

a first guide surface adjacent to the transport nip;

a second guide surface spaced from the first guide surface;

a plurality of guide members extending from the first guide surface to the sheet separator, wherein the sheet separator includes an elongated housing containing a plurality of openings, and each of the plurality of guide members extends through one of the plurality of openings; and a substantially uninterrupted media path between the sheet separator and the first guide surface, the media path defined by the second guide surface and at least one guide member to direct a sheet of media toward the transport nip.

9. A method of guiding a sheet of media from a media supply apparatus to a transport nip, the method comprising the steps of:

providing a first guide surface adjacent to the transport nip;

providing a second guide surface spaced from the first guide surface;

providing a sheet separator that is movable within the media supply apparatus;

providing a plurality of guide members that extend from the first guide surface to the sheet separator, wherein the sheet separator includes an elongated housing containing a plurality of openings, and each of the plurality of guide members extends through one of the plurality of opening;

providing at least one guide member that extends from the first guide surface to the sheet separator to define at least a portion of a substantially uninterrupted media path between the sheet separator and the transport nip; and contacting the sheet of media with the sheet separator to advance the sheet between the at least one guide member and the second guide surface and into the transport nip.

10. The method of guiding a sheet of media of claim 9, further including the steps of:

moving the sheet separator within the media supply apparatus to adjust to a height of media sheets within the media supply apparatus; and extending the at least one guide member to maintain the substantially uninterrupted media path between the sheet separator and the transport nip.

11. The method of guiding a sheet of media of claim 9, further including the step of providing a flexible strip for the at least one guide member.

12. The method of guiding a sheet of media of claim 11, further including the step of providing plurality of guide members that span a substantially full width of the sheet of media.

* * * * *

UNITED STATES PATENT AND TRADEMARK OFFICE

CERTIFICATE OF CORRECTION

PATENT NO. : 6,296,244 B1
DATED : October 2, 2001
INVENTOR(S) : David W. Hanks and Donald B. MacLane It is certified that error appears in the above-identified patent and that said Letters Patent is hereby corrected as shown below:

Title page,
Item [75], Inventors, "Donald B. MacLane," delete "both" and insert
-- Carl T. Urban, all --.

Signed and Sealed this

Twenty-fourth Day of September, 2002

*Attest:*

*Attesting Officer*

JAMES E. ROGAN
*Director of the United States Patent and Trademark Office*